United States Patent [19]

Sommer

[11] Patent Number: 4,601,640

[45] Date of Patent: Jul. 22, 1986

[54] OIL WELL PUMP

[76] Inventor: Gordon M. Sommer, 2324 Date Palm Rd., Boca Raton, Fla. 33432

[21] Appl. No.: 596,055

[22] Filed: Apr. 2, 1984

Related U.S. Application Data

[63] Continuation-in-part of Ser. No. 327,717, Dec. 4, 1981, abandoned.

[51] Int. Cl.[4] ..... F04B 49/00; F04B 35/04; F16H 3/14

[52] U.S. Cl. ..... 417/12; 417/44; 417/223; 417/415; 92/137; 74/361

[58] Field of Search ..... 417/12, 44, 45, 223, 417/415; 92/137; 74/361; 192/51

[56] References Cited

U.S. PATENT DOCUMENTS

| | | | |
|---|---|---|---|
| 1,248,735 | 12/1917 | Sitney | 74/361 |
| 1,364,325 | 1/1921 | Sitney | 74/361 |
| 2,729,981 | 1/1956 | Budzien | 74/361 |
| 2,892,356 | 6/1959 | Sinclair | 74/361 |
| 2,926,000 | 2/1960 | Allen | 74/89.22 |
| 3,256,745 | 6/1966 | Kramer et al. | 74/361 |
| 3,285,081 | 11/1966 | Kuhns et al. | 417/44 |
| 3,516,762 | 6/1970 | Grable et al. | 417/362 |
| 3,521,445 | 7/1970 | Grable | 60/22.1 |
| 3,540,559 | 11/1970 | Shore | 192/51 X |
| 3,550,735 | 12/1970 | Olsen | 192/51 X |
| 3,613,469 | 10/1971 | McRoberts et al. | 74/361 |
| 3,642,049 | 2/1972 | Lyman | 74/810 |
| 3,741,360 | 6/1973 | Patton | 192/51 X |
| 3,744,567 | 7/1973 | Grable | 166/315 |
| 3,793,904 | 2/1974 | Grable | 74/590 |
| 3,807,902 | 4/1974 | Grable | 417/46 |
| 3,973,445 | 8/1976 | Ballard | 74/89.22 X |
| 4,062,640 | 12/1977 | Gault | 417/415 |
| 4,076,218 | 2/1978 | Gault | 74/89.22 X |

FOREIGN PATENT DOCUMENTS

| | | | |
|---|---|---|---|
| 227843 | 10/1943 | Switzerland | 74/361 |
| 1237214 | 6/1971 | United Kingdom | 74/361 |
| 590526 | 2/1978 | U.S.S.R. | 192/51 |

*Primary Examiner*—William L. Freeh

*Attorney, Agent, or Firm*—Harness, Dickey & Pierce

[57] ABSTRACT

An oil pump assembly having an adjustable production rate and capable of long stroke, low stroke per minute pumping rates, comprising a reciprocating pumping rod in a well hole, a counterbalancing mechanism for reducing the power needed to pump oil by the pumping rod, a driving mechanism to drive the reciprocating pumping rod and the counterbalancing mechanism, including a first cable and a second cable, to drive the reciprocating pumping rod and the counterbalancing mechanism, respectively, a speed control for the driving mechanism, and a dwell mechanism for the driving mechanism.

15 Claims, 5 Drawing Figures

OIL WELL PUMP

CROSS-REFERENCE TO RELATED APPLICATION

This application is a continuation-in-part of U.S. Ser. No. 327,717, filed Dec. 4, 1981, now abandoned.

BACKGROUND AND SUMMARY OF THE INVENTION

The present invention relates generally to the pumping of wells such as oil wells, and in particular to an oil well pump assembly having an adjustable production rate capable of long stroke, low stroke per minute pumping rates.

Prior art oil wells have been pumped for many years with a walking beam pump having a relatively large crank and arm assembly providing a sharp acceleration and deceleration of a pump rod. The walking beam arrangement needed a number of reversals per minute of the pump along with a short stroke pumping rod to provide sufficient production. With a walking beam pump, the pumping rod had to be larger than desired since the end of the rod never catches up with the pump in the pumping process and the effective stroke of the rod due to the elasticity of the rod was always less than the actual length of the rod. Also, the crank had to be physically changed in order to change the production rate of the pump.

Improvements were made to the walking beam pumping arrangement by those systems described in U.S. Pat. Nos. 3,744,567, 3,793,904, and 3,807,902, where long stroke pumping assemblies were devised which had counterbalanced weights reciprocally attached to the well pump to move the pumping mechanism and aid the pumping mechanism by the force of gravity on its return stroke. Several disadvantages have presented themselves with the use of the prior art reciprocal well pumps as disclosed in the above-referenced patents. First, each of the pumps uses a direct current motor on a spiral (a varying diameter spool) with a hydrostatic drive. The hydrostatic drive does not have a great deal of longetivity and requires a complex set of controls in order to operate the unit. The device as represented by the referenced prior art patents also only controls the speed of the unit. Furthermore, side loads are imposed on the sucker rods of the above-referenced patents.

The present invention has the object of using an oil shear clutch mechanism and brake mechanism to control the operation of a counterbalanced well pump. Such an arrangement permits an alteration in the speed of the unit and also in the dwell time of a unit at the top and the bottom of each stroke, to allow the rod to catch up with the unit and have an effective stroke of the length of the rod. Furthermore, the present invention has an object of eliminating side loads imposed by the sucker rods to extend the life of the unit, while also providing the capability of using a fairly compact housing and substituteable parts associated with that housing to optimize the loading condition of the sucker rods for various stroke lengths and minimize the side loads on the sucker rods in each desired load condition or stroke length.

Each of the above advantages is also meant to be included with a pump assembly that has an adjustable production rate readily adjustable externally of the pump assembly. The production rate can be monitored by a main computer by monitoring the sampling and the motor amperage to consistently provide an optimum condition in the performance of the pump. This same computer may be monitoring a number of the pump assemblies of the present invention.

The prior art units also had an energy disadvantage due to the rough acceleration of the unit taking power away from the operation of the unit. The present invention has an energy advantage over the prior art due to the provision of a controlled ramp for acceleration and deceleration of the pump assembly.

The present invention also has the object of providing a pump assembly which is potentially ecologically aesthetic for areas that find objection to large observable well pumps. The present invention may be constructed to have an effective physical size of 5 to 7 feet above ground level, which, in a commercial or residential setting, could locate the unit underneath the parking lot, surrounded by a fence or hedge, within a small attractive housing structure, or in another ecologically aesthetic surrounding. Such a use would also permit the surface real estate to be utilized for something else other than a mere well pumping station. A small pump assembly may also be more amenable to protection against vandalism and the pumps may be situated more closely together, as a series of directional wells to obtain a higher density than prior art well pumps. The present invention also has a much lower weight than the prior art units, which may provide an advantage particularly for off-shore wells where a number of the pumps may have to be attached to a vehicle rig. In addition, the pump assembly of the present invention has the advantage of providing a compact housing assembly for its drive mechanism to contribute to the overall aesthetically appealing compact size of the pump assembly.

The present invention also has the advantage of minimizing both service and original manufacture and installation costs by minimizing the number of parts. The present invention utilizes a single continuous cable extending between the reciprocating pumping means and the counterbalance means, which cable is looped around a single drum element driven by the driving means in alternate directions. The present invention further has the object of maintaining driving forces between the drum and the cable.

Essentially, the present invention provides a simplified, more compact, and potentially more ecologically appealing unit than the prior art.

Additional objects and advantages of the invention, as well as the details of an illustrative embodiment, be more fully understood from the following description and drawings.

DETAILED DESCRIPTION OF THE PREFERRED EMBODIMENTS

Figure 1:
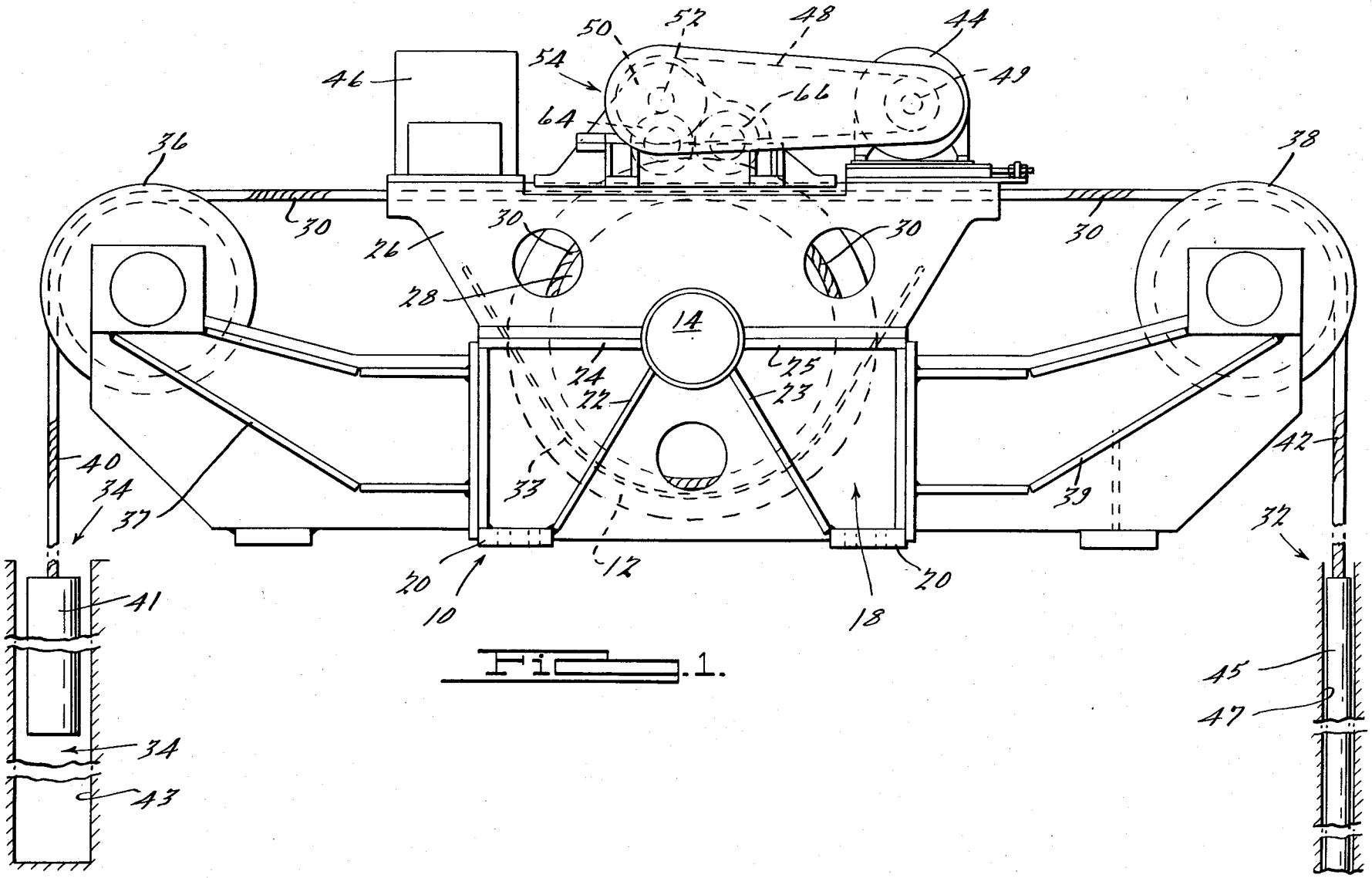
FIG. 1 is a side elevational view of the counterbalanced pump of the present invention.
Figure 2:
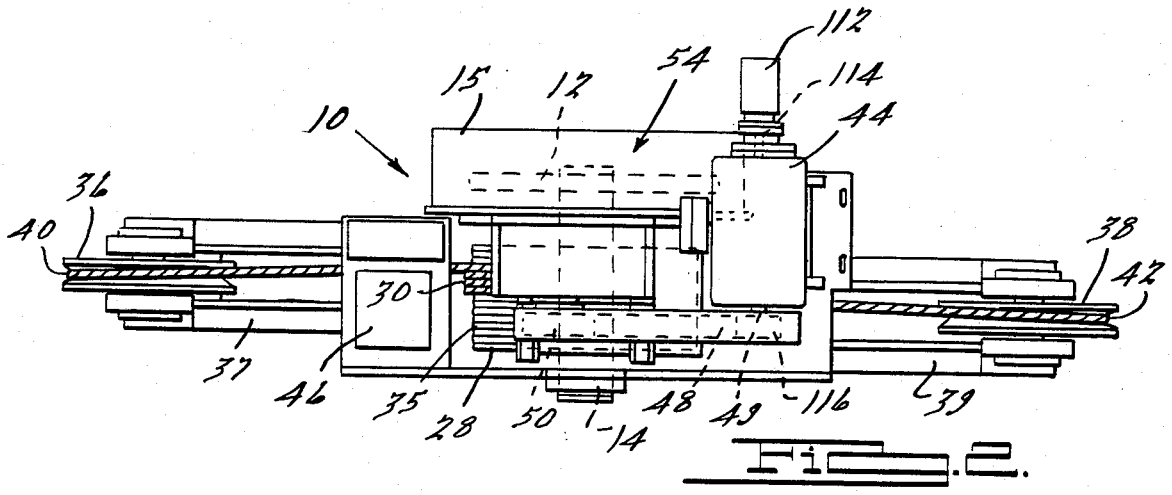
FIG. 2 is an elevated plan view of the drive unit of FIG. 1.
Figure 3:
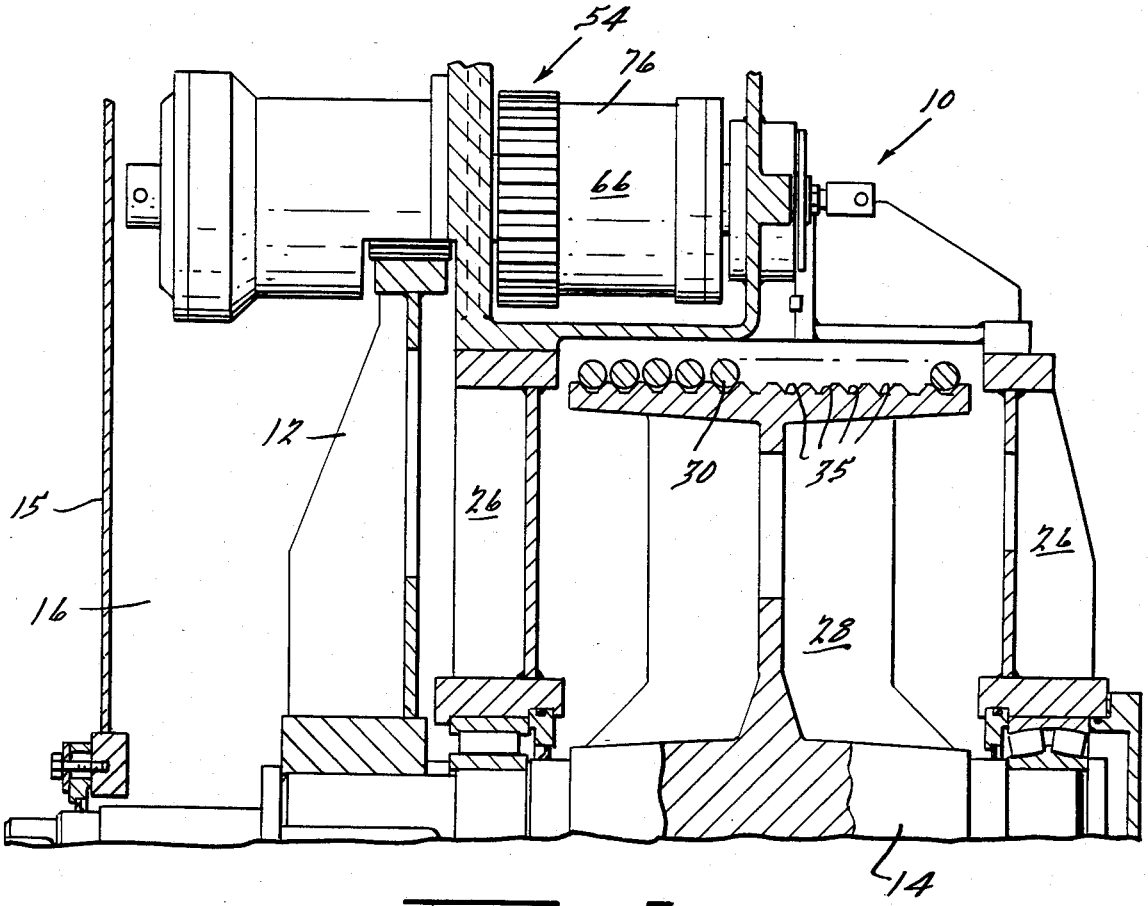
FIG. 3 is an elevated side view of the pump of FIG. 1.

Referring to FIGS. 1 and 2, a pump assembly 10 is illustrated using a bull gear 12 rotatable on a shaft 14 within a housing 15 forming an oil chamber 16, and secured to the shaft 14 by suitable key (not shown). The shaft 14 is mounted in a support housing 18, including a base member 20, lower shaft support members 22 and 23, upper shaft support members 24 and 25, and drive support member 26. A drive drum element 28 rides on the shaft 14 within the housing 18 and is operably mounted on the shaft 14 by suitable key elements. A continuous cable 30 is wrapped around the drive element 28 and releases from drive element 28 in one direction to associate with a pumping means 32 and in a second opposite direction to associate with a counterbalancing means 34.

The drum element 28 has a series of grooves 35 disposed thereon to guide the cable 30 onto the drum element 28 and maintain some separation between the rows of the cable 30 as it is wrapped around or taken from the drum element 28. A curved plate 33 (FIG. 1) is disposed below and adjacent to the drum element 28 with a very small clearance between the drum element 28 and the plate 33 to further guide the cable 30 into one of the grooves 35 and maintain the position of the cable 30 within each respective groove 35 as the drum element 28 is rotated.

A pair of idler pulleys 36 and 38 are mounted to outriggers 37 and 39 which are, in turn, removeably mounted to the main housing 18 on a rotational axis parallel to that of the drive element 28. In the described embodiment, the rotational axes of the idler pulleys 36 and 38 are disposed in a plane disposed above and not intersecting the rotational axis of the drive element 28. The cable 30 forms substantially a horizontal line connecting the top point of the drive element 28 and idler pulleys 36 and 38. The cable portion 40 associated with the counterbalanced means 34 comes from the top of the driving element 28 over the idler pulley 36 and down to the counterbalance means 34 comprising weights 41 in a hole 43 adjacent the pump assembly 10. The cable portion 42 is directed upwardly from the bottom of the drive element 28 over the top of idler pulley 38 and downwardly into operable association with pumping means 32 comprising a sucker rod 45 in the well hole 47. The operable association of the cable portions 40 and 42 with the sucker rod 45 in the well hole 47 and the weights 41 in the counterbalance hole 43 is done conventionally and need not be discussed in detail here. The outriggers 37 and 39 are removeable to facilitate servicing either the pumping means 32 or the counterbalance means 34.

A motor 44 and motor control 46 are mounted onto the drive support member 26 of the housing 18. A belt 48 from the drive shaft 49 motor 44 is operably associated with a fly wheel pulley 50 mounted on a shaft 52 of a pump drive unit 54 also mounted on the drive support member 26.

Figure 4:
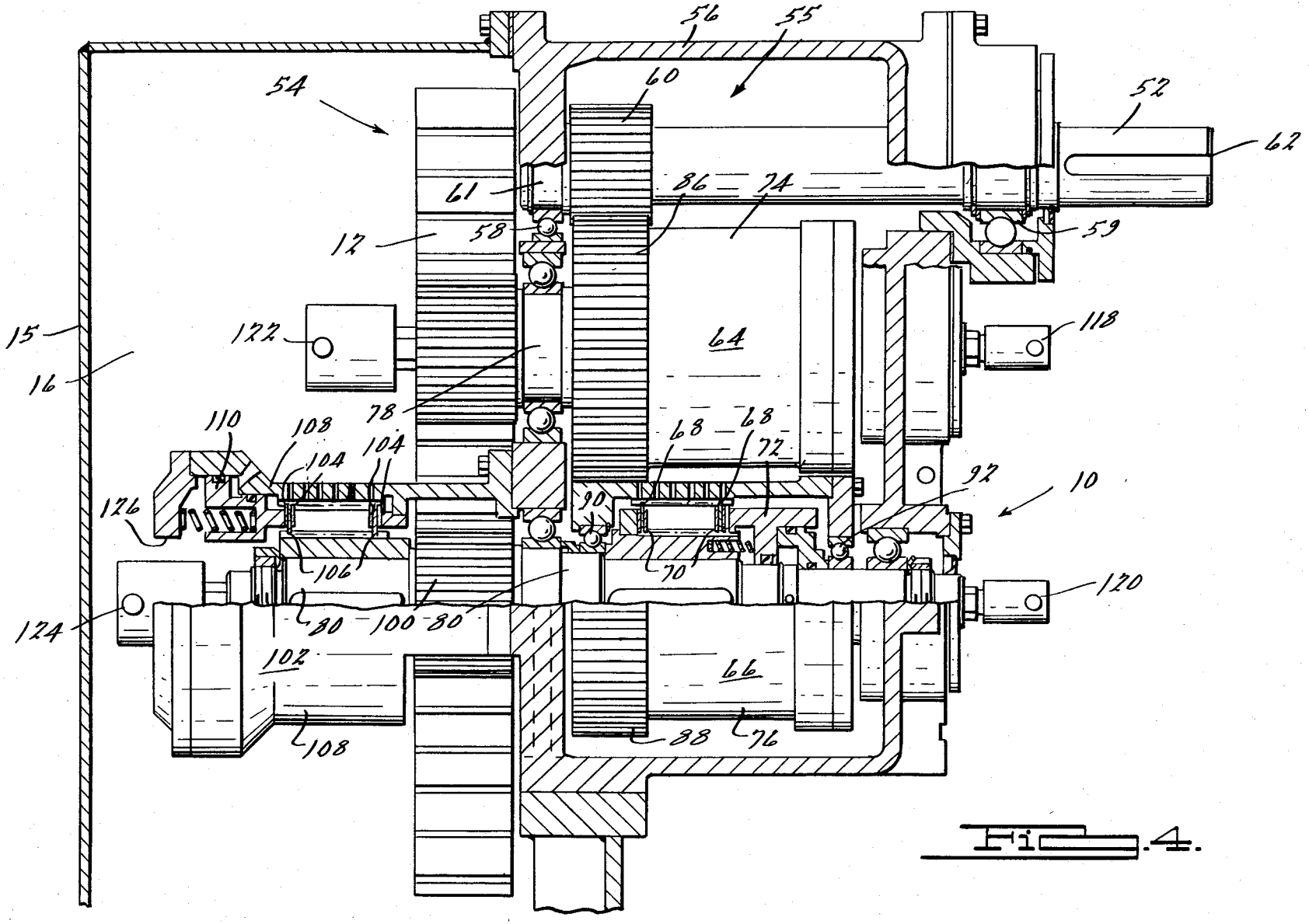
FIG. 4 is a horizontal sectional view of FIG. 1 along the lines 4—4.

Referring to FIG. 4, the input shaft 52 of a power engaging unit 55 is mounted in a housing 56, via suitable bearing assemblies 58 and 59. A pinion gear 60 is mounted on the shaft 52 at substantially one end 61 thereof, axially opposite the drive engagement end 62 of the shaft 52. Two clutches, a raising clutch 64 and a lowering clutch 66 are mounted in parallel to the input shaft 52 and to one another within the housing 56. The clutches 64 and 66 comprise a series of plates 68 and discs 70 in a bath of oil similar to those oil shear clutches described by applicant's U.S. Pat. No. 3,696,898, actuatable by an externally controlled piston 72 into engagement and disengagement. The plates 68 are cooperably associated to move with an external clutch housing 74 or 76 of the clutches 64 or 66, respectively, disposed within the drive housing 52. The discs 70 are splined to rotatable shafts 78 or 80 of the clutches 64 or 66, respectively. The piston 72 of each clutch forms a chamber 82 with the extended portion 84 of each shaft 78 or 80. A spring 73 is operably associated with each piston 72 to bias each piston 72 to a position where the clutches 64 and 66 are not engaged.

Reduction gears 86 and 88 are fixedly secured to outside of the clutch housings 74 and 76, respectively, and intermesh with one another so that the gears 86 and 88 are driven in opposite directions. The clutch housings 74 and 76 are rotatably mounted to the shafts 78 and 80 by suitable bearing mechanisms 90 and 92 on both housing 74 and housing 76 (not shown). The pinion gear 60 of the input shaft 52 meshes with the clutch housing gear 86 of clutch 64 to drive the mechanism (in turn meshing with gear 88). A pinion gear 98 is mounted on shaft 78 and a second pinion gear 100 is mounted on shaft 80 to operably mesh with the drive bull gear 12 of the pump assembly 10. Thus, when the plates and the discs of clutch 64 are operably engaged, the pinion gear 98 will rotate in one direction to drive the bull gear 12 to raise the sucker rod 45 vertically in the well hole 47. Clutch 64 then is disengaged and clutch 66 is engaged to drive pinion gear 100, which in turn drives the bull gear 12 in the opposite direction to lower the sucker rod in the well hole.

A brake mechanism 102 is also mounted on the shaft 80 of the lowering clutch 66. The brake mechanism 102 also comprises a series of plates 104 and discs 106 with the plates 104 operably splined with a stationary external housing 108 and with the discs 106 operably splined to the shaft 80, to be actuated by piston 110 into engagement to brake the assembly 10. The piston 110 moves in a chamber 109 having a port 111 to which a conduit may be connected. A return spring 113 biases the piston 110 into a piston to actuate the brake 102. The brake unit 102 as illustrated has been attached to the shaft 80 of the lowering clutch 66 but may, if space considerations allow, be attached to shaft 78 of the raising clutch 64 just as readily and be within the scope of the present invention.

A sensor or transducer 115 is also provided at the engagement end 62 of the drive shaft 52 to determine the stroke drive speed and position of the unit. The transducer or sensor 115 may be one of many types of conventional angular displacement and speed transducers or sensors on the market which are disposed in association with the end of a rotating shaft.

Oil is circulated through the power engaging unit 55 by a pump 112 (FIG. 2). Drive shaft 49 of the motor 44 extends axially in both directions from the motor 44, with one end 114 driving the oil pump 112 and the other end 116 driving the belt 48. Actuation oil is fed from the pump 112 to the clutches 64 and 66 via inlet ports 118 and 120 and to the brake 102 via inlet port 111 through a control system described below. Cooling oil is fed to clutches 64 and 66 and brake 102 via inlet ports 122 and 124 at the opposite side of the unit 58 from the clutch actuating oil ports 118 and 120. Cooling oil inlet ports 122 and 124 are disposed within housing 15. Brake housing 108 has an outlet portion 126 that communicates with the oil sump in housing 15.

Figure 5:
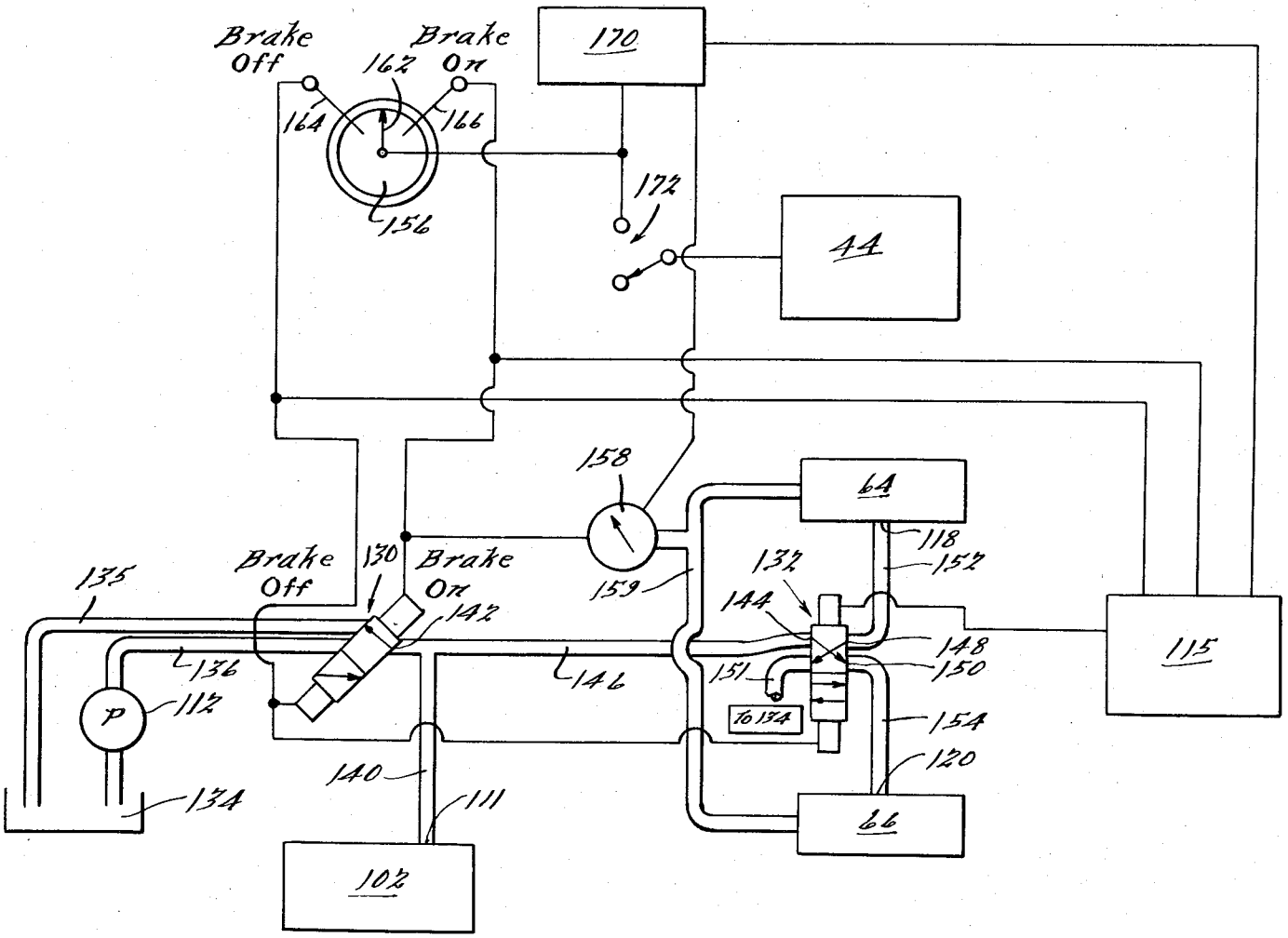
FIG. 5 is a schematic diagram of the apparatus of the present invention including the control system therefor.

Thus, referring to FIG. 5, the clutches 64 and 66 are alternately engaged and disengaged to provide the lowering and the raising of the sucker rod 45 in the well hole 47 via control of two two-way oil control valves 130 and 132 controlling the flow of oil from an oil reservoir 134 via the pump 112. The pump 112 communicates with the first valve 130 via a conduit 136. The first valve 130 has a port 142 which communicates in the "brake off" position with both the inlet port 144 to the second valve 132 via conduit 146 and also with the piston chamber 109 of the brake 102 via conduit 140. In the "brake on" position, the port 142 bleeds oil to conduit 135 and back to the reservoir 134.

The second valve 132 has two sets of ports 148 and 150 which alternatively communicate with the piston chamber (not shown) of the raising clutch 64 via conduit 152 and port 118 and the piston chamber 82 of the lowering clutch 66 via conduit 154, port 120, and oil passage 155 (FIG. 4). The alternative of the two ports 148 and 150 will dump through the valve 132 to the reservoir 134 via conduit 151.

The valves 130 and 132 and the motor 44 are interconnected within a control mechanism receiving input signals from the position transducer 115, an adjustable contacts ammeter 156 (increasing in value in a counterclockwise direction as shown in FIG. 5), and an oil pressure sensor 158 to control the valves 130 and 132 that, in turn, control the brake 102 and clutches 64 and 66.

If the oil pressure sensor 158 indicates less than adequate oil pressure in the housings 74 or 76 of the clutches 64 and 66, via conduit 159, the oil valve 130 will be positioned by signal from the sensor 158 to maintain the brake 102 actuated to prevent a falling runaway condition. Contact between the ammeter needle 162 and one of the adjustable contacts 164 or 166 of the ammeter 156 energizes the valve 130 in one direction or the other to send pressurized oil from the reservoir 134 via the pump 112 to either the brake 102 or alternatively to one of the clutches 64 or 66. The electric motor 44 is preferably run continuously through the operation of the pump assembly 10.

The position transducer monitors the angular displacement of a selected shaft 52 and signals when a selected interval of displacement has been obtained by that shaft, at which point a signal is sent to the valve 130 to actuate that valve into cutting off the flow of oil to the brake 102 to actuate the brake 102. The ammeter needle 162 will move in response to the increased resistance to current flow until the needle 162 contacts the "brake off" adjustable contact 164 at which point the valve 130 is signal pulsed into flowing oil to the "down" clutch 66 to commence lowering the sucker rod 45 into the well hole 47 and the transducer 115 is reset by a pulse signal to zero. Once movement begins, the transducer 115 starts to measure displacement. At the selected number of revolutions, a signal pulse is emitted from the transducer 115 to the clutch valve 132 to move the valve 132 to communicate oil to the "up" clutch 64 and commence lifting the sucker rod 45 in the well hole 47. The transducer 115 moves in the opposite direction with its associated shaft until it reaches its original starting point at which time a signal is pulsed to the valve 132 to again cut off oil flow to actuate the brake 80, and recommence the cycle.

Suitable protective devices to guarantee one way flow, such as between the transducer 115 and "on" side of valve 130, are not shown in the schematic and are believed to be conventional. Any time the current falls or the cycle is initially starting its first stroke, the ammeter 156 will default to a brake "on" condition by contact between the needle 162 and the "on" contact 166. An electrical power source 170 energizes the control system, as shown in FIG. 5, as well as the electric motor 44 through a conventional on/off switch 172.

The brake 102 is engaged at the end of each stroke to provide a dwell setting to permit the sucker rod 45 to catch up with the unit and permit the effective length of the rod 45 to be used without any wasted length. The engagement and disengagement of the clutches 64 and 66 is performed by any conventional oil control mechanism, but one is preferred having a ramp acceleration and deceleration of the clutch engagement.

It must be noted that the denomination of the clutches as "raising" and "lowering" is relative. The cluctches may be oppositely denominated if set up in a manner wherein the sucker rod 45 is controlled by the opposite drive pulley.

It can be readily seen that the dwell time of the unit 10 may be readily altered to any selected dwell time based upon the amount of time that the brake 102 is engaged. Also the speed of the unit may be readily controlled by the automatic control that presents oil to the clutches 64 and 66 of the unit and the speed control of the drive motor 44. In the present construction, a forty to fifty foot stroke may be used. A four second dwell between reversals has been found to be sufficient to permit a ten foot sucker rod to catch up at each stroke reversal. This dwell, of course, may be changed over the lifetime operation of the well as the flow rate changes. It is believed, however, that only discrete changes will be necessary, with no need for automatic feedback controls nor for minute variance alterations of the dwell setting.

An adjustable production rate is also readily available from the above-described pump assembly 10, since the pump speed and dwell time are so easily controllable as desired without the complexities of a hydrostatic drive. A flow rate sampling and the motor amperage can be monitored by conventional means while the sucker rod travels upwardly and speed and dwell can be adjusted so that optimum conditions may be consistently maintained. One example of a monitor means for the motor current on the upward portion of the pumping stroke is described above by the ammeter 156 with adjustable contacts 164, 166 connected to the electric drive motor 44. The distance between the contacts 164, 166 will then be the dwell time that the brake 102 will operate and adjustment of the distance between the contacts 164, 166 may be a means of adjusting the amount of dwell time.

The monitoring of several of the units 10 of the present invention may be performed at a single station or by a central computer. Plug-in monitors may also be readily implemented for monitoring individual units without interfering with or stopping the operation of the unit 10, since motor amperage, dwell time, and sampling can be performed with interfering with or stopping the operation of the unit.

Thus, there is disclosed in the above description and the drawings an improved oil well pump drive unit which fully and effectively accomplishes is the objectives thereof. The dimensions and operating times set forth in the above specifications are merely representative and are not meant to be limiting on the scope of the invention. It would be apparent that variations and modifications of the disclosed embodiments may be made without departing from the principles of the invention or the scope of the appended claims.

I claim:

1. An oil well pump assembly including means for pumping oil from an oil well through a well hole, comprising a pumping rod and means for reciprocating said pumping rod in said well hole, counterbalance means for reducing the power needed to pump said oil, motor means, means for driving said reciprocating means, and means for driving said counterbalance means, the improvement comprising:

means for engaging said motor means alternately with said reciprocating driving means and said counterbalance driving means comprising oil shear clutch means operably associated with said reciprocating means, driving means to raise said reciprocating means, and oil shear clutch means operably associated with said counterbalance means, driving means to raise said counterbalance means; and dwell means for stopping both said reciprocating means and said counterbalance means in a selected position for a selected amount of time comprising oil shear brake means.

2. A pump assembly in accordance with claim 1, wherein said engaging means further comprises gear means for interconnecting said driving means with each of said oil shear clutch means.

3. A pump assembly in accordance with claim 2, wherein each of said oil shear clutch means is operably associated with a drive shaft.

4. A pump assembly in accordance with claim 3, wherein said oil shear brake means is operably disposed on the drive shaft of one of said oil shear clutch means.

5. A pump assembly in accordance with claim 4, further comprising gear means for interconnecting said drive shafts of said clutch means with said reciprocating means and said counterbalance means.

6. A pump assembly in accordance with claim 5, wherein said gear means for interconnecting said drive shafts of said clutch means comprises a pinion gear on each of said drive shafts and a bull gear disposed in meshing engagement with both of said pinion gears and drivingly engaged to both said reciprocating means and said counterbalance means.

7. A pump assembly in accordance with claim 1, wherein said reciprocating means includes a cable, said pump assembly further comprising means for minimizing sideloads imposed on said pumping rod.

8. A pump assembly in accordance with claim 7, wherein said counterbalance means includes a cable, said pump assembly further comprising means for minimizing sideloads imposed on said counterbalance means.

9. A pump assembly in accordance with claim 8, wherein said cable of said counterbalance means and said cable of said reciprocating means comprise one continuous cable.

10. An oil well pump assembly including means for pumping oil from an oil well through a well hole comprising a pumping rod and means for reciprocating said pumping rod in said well hole, counterbalance means for reducing the power needed to pump said oil, and means for driving said reciprocating means and said counterbalance means, the improvement comprising:

means for engaging said driving means alternately with said reciprocating means and said counterbalance means; and dwell means for stopping both said reciprocating means and said counterbalance means in a selected position for a selected amount of time, including oil shear brake means.

11. An oil well pump assembly including means for pumping oil from an oil well hole comprising a pumping rod and means for reciprocating said pumping rod in said hole, counterbalance means for reducing the power needed to pump said oil, and means for driving said reciprocating means and said counterbalance means, including electric motor means, the improvement comprising:

means for adjusting the production rate of said pump assembly comprising means for controlling the speed of said electric motor means; and means for dwelling said pump assembly a selected amount of time between reciprocations of said pumping rod by said reciprocating means comprising oil shear brake means operably associated with said driving means, means for detecting the end of a stroke operably associated with at least one of said reciprocating means or said counterbalance means, means for monitoring current from said electric motor means, including signal means, and means for engaging and disengaging said brake means in response to signals from said monitoring means.

12. A pumping assembly in accordance with claim 1, further comprising means to control against all runaway of said pumping rod including means for sensing the oil pressure in said driving means and means for engaging said brake means until a selected oil pressure is obtained.

13. A pumping assembly in accordance with claim 11, further comprising means for controlling the acceleration and deceleration of the pumping means as a ramp function.

14. A pump assembly in accordance with claim 11, further comprising means for monitoring the flow rate of said oil pumping means wherein said adjusting means includes means for controlling the speed of said motor in response to the output of said current and flow rate monitoring means.

15. A pump assembly in accordance with claim 14, further comprising means for adjusting the time of dwell provided by said dwelling means in response to the output of said monitoring means.

* * * * *

UNITED STATES PATENT AND TRADEMARK OFFICE

CERTIFICATE OF CORRECTION

PATENT NO. : 4,601,640

DATED : July 22, 1986

INVENTOR(S) : Gordon M. Sommer

It is certified that error appears in the above-identified patent and that said Letters Patent is hereby corrected as shown below:

ON THE TITLE PAGE under "U.S. Patent Documents, Attachment to Paper No.3. Reference "J". Insert --4,108,280 - 8/78 - Eastcott et al--.

Col. 1, Line 60, "substituteable" should be --substitutable--.

Col. 2, line 53, After "embodiment," insert --may--.

Col. 3, line 57, After "49" insert --of the--.

Col. 4, line 44, "piston" should be --position--.

Col. 6, line 20, "cluctches" should read -- clutches --.

Col. 6, line 67, Delete "is".

Col. 8, line 41, "1" should be --11--.

Signed and Sealed this

Thirty-first Day of March, 1987

*Attest:*

DONALD J. QUIGG

*Attesting Officer*

*Commissioner of Patents and Trademarks*